US012179069B2

(12) United States Patent
Woo

(10) Patent No.: US 12,179,069 B2
(45) Date of Patent: Dec. 31, 2024

(54) AUTOMATIC TABLE TENNIS TRAINING APPARATUS

(71) Applicant: Bok-Yeon Woo, Busan (KR)

(72) Inventor: Bok-Yeon Woo, Busan (KR)

( * ) Notice: Subject to any disclaimer, the term of this patent is extended or adjusted under 35 U.S.C. 154(b) by 673 days.

(21) Appl. No.: 17/442,827

(22) PCT Filed: Mar. 3, 2020

(86) PCT No.: PCT/KR2020/003025
§ 371 (c)(1),
(2) Date: Sep. 24, 2021

(87) PCT Pub. No.: WO2020/197117
PCT Pub. Date: Oct. 1, 2020

(65) Prior Publication Data

US 2022/0193504 A1 Jun. 23, 2022

(30) Foreign Application Priority Data

Mar. 27, 2019 (KR) ..... 10-2019-0035378
Feb. 27, 2020 (KR) ..... 10-2020-0024617

(51) Int. Cl.
*A63B 47/02* (2006.01)
*A63B 67/04* (2006.01)
*A63B 69/40* (2006.01)
*A63B 71/06* (2006.01)

(52) U.S. Cl.
CPC ..... *A63B 47/025* (2013.01); *A63B 67/04* (2013.01); *A63B 69/40* (2013.01); *A63B 71/06* (2013.01)

(58) Field of Classification Search
CPC ..... A63B 47/025; A63B 47/04; A63B 69/40; A63B 71/06
See application file for complete search history.

(56) References Cited

U.S. PATENT DOCUMENTS 4,002,336 A * 1/1977 Beaver ..... A63B 69/409 124/56
8,257,204 B1 * 9/2012 Liu ..... A63B 47/025 473/475
2021/0379446 A1 * 12/2021 Weinlader ..... A63B 61/00

FOREIGN PATENT DOCUMENTS

CN 112107843 A * 12/2020 ..... A47B 25/003
CN 112138345 A * 12/2020
CN 112933569 A * 6/2021 ..... A63B 47/02
JP 08107953 A * 4/1996
JP 2001037936 A * 2/2001
JP 2008246174 A * 10/2008
KR 101564191 10/2015
KR 101602065 3/2016
KR 101622889 5/2016
KR 20160138425 12/2018
KR 1992961 B1 * 6/2019 ..... A63B 47/025
KR 102053903 B1 * 12/2019 ..... A63B 69/40
(Continued)

*Primary Examiner* — Raleigh W Chiu
(74) *Attorney, Agent, or Firm* — IPLA P.A.

(57) ABSTRACT

An automatic table tennis training apparatus includes: a rectangular table tennis table; a pitching machine; a collecting stand; a fence part; a blowing part for blowing the table tennis balls dropped to the ground to move the table tennis balls towards one side end of the lower guide located under the table tennis table; and a transfer part for sucking the table tennis balls moving to one side end of the lower guide to transfer the table tennis balls to the collecting stand.

11 Claims, 17 Drawing Sheets

(56) References Cited

FOREIGN PATENT DOCUMENTS

| | | | | | |
|---|---|---|---|---|---|
| KR | 2070025 | B1 | * | 1/2020 | ..... A63B 47/025 |
| KR | 2021098824 | A | * | 8/2021 | ..... A63B 47/025 |
| KR | 102464742 | B1 | * | 11/2022 | ..... A63B 67/04 |

* cited by examiner

AUTOMATIC TABLE TENNIS TRAINING APPARATUS

BACKGROUND

The present invention relates to an automatic table tennis training apparatus, and more particularly, to an apparatus which is configured as a circulation-type structure in which table tennis balls that fell to the ground are automatically collected and then supplied to a pitching machine, so that effective table tennis training can be carried out alone without the need to collect, one by one, the table tennis balls scattered everywhere during training.

Generally, table tennis is one of sports that is liked by a lot of people for a long time, because table tennis can be played at a very low cost, on a narrow place, and with a few players, while giving high exercising effects to the players, and as the number of participants in table tennis has increased, besides, table tennis becomes a popular ball sport.

However, table tennis is played with at least two or more players, while placing a table with a given size between the players to hit a ball with rackets, and accordingly, playing table tennis alone is impossible. Besides, there are limitations in training table tennis, and during training, the table tennis balls hit by a player should be collected one by one, thereby making the player feel tired, rather than excited.

Accordingly, an apparatus for providing an environment in which a player can enjoy playing table tennis alone has to be required, and such conventional apparatuses have been disclosed in Korean Patent No. 10-1564191 entitled "Table tennis training apparatus", and Korean Patent No. 10-1622889 entitled "Ball sport training apparatus".

The conventional table tennis training apparatus as disclosed in Korean Patent No. 10-1564191 is configured to allow table tennis balls to be launched from a robot installed on an end line of a table tennis table, while the table tennis balls dropped to the floor are being induced to an inducing recess and then supplied to the robot, so that training table tennis alone is possible and there is no need to collect the table tennis balls by a player. The conventional ball sport training apparatus as disclosed in Korean Patent No. 10-1622889 is configured to allow an inclination to be formed on a ball park so that training balls can be automatically collected and after the collection, they are supplied to a dispenser, thereby enabling even a single player to enjoy a ball sport such as foot volleyball.

Further, an apparatus or system, which is capable of measuring and providing scores, even in the state of having no feedback with opponents, to thus make training more effective and interesting, is needed, and such conventional system and apparatus have been disclosed in Korean Patent No. 10-1602065 entitled "Automatic table tennis score displaying system and method", and Korean Patent No. 10-1945935 entitled "Table tennis serve practice apparatus".

The conventional automatic table tennis score displaying system and method as disclosed in Korean Patent No. 10-1602065 is configured to sense vibration values of a table tennis table and areas on which vibrations are generated, calculate scores, transmit the calculated scores wirelessly, and display the scores, thereby measuring the scores accurately and easily. The conventional table tennis serve practice apparatus as disclosed in Korean Patent No. 10-1945935 is configured to have a plurality of sensors for sensing sections divided on a table tennis table so that in a state where any one of the sensors is activated, the sensor senses the position of the table tennis table, at which the table tennis ball bounces, and the vibration generated from the bouncing, thereby enabling a player to recognize a degree of accuracy in his or her hitting.

Accordingly, there is a need to develop a table tennis training apparatus capable of improving the conventional table tennis training apparatuses to make it possible to provide playing table tennis alone, while giving many conveniences to a player, thereby ensuring more effective training.

SUMMARY OF THE INVENTION

To gently play or train table tennis, at least two or more players are needed, so that there are limitations in training table tennis alone.

Further, the player has to collect, one by one, table tennis balls hit by him or her, thereby causing his or her fatigue.

Accordingly, there is a need to develop an apparatus capable of giving a table tennis player a higher degree of excitement and more effective training than the conventional apparatuses, and it is an object of the present invention to provide an automatic table tennis training apparatus capable of solving the conventional problems as mentioned above.

TECHNICAL SOLUTION

To accomplish the above-mentioned objects, according to the present invention, there is provided an automatic table tennis training apparatus including: a rectangular table tennis table divided into a first court on one side thereof and a second court on the other side thereof, with respect to a net disposed vertically thereon in a width direction thereof, and having a height determined by support posts supporting the underside thereof; a pitching machine located on an end portion of the first court to launch, towards the second court, table tennis balls supplied sequentially thereto; a collecting stand located on the end portion of the first court, to collect the table tennis balls that have been transferred or dropped and supply the table tennis balls to the pitching machine; a fence part having a lower guide located horizontally with respect to the ground and a net cage provided upward from the lower guide to thus form a space in which the table tennis table is placed, to limit the escape range of the table tennis balls, and to guide the movement directions of the table tennis balls dropped to the ground; a blowing part for blowing the table tennis balls dropped to the ground to move the table tennis balls towards one side end of the lower guide located under the table tennis table; and a transfer part for sucking the table tennis balls moving to one side end of the lower guide to transfer the table tennis balls to the collecting stand, whereby the table tennis balls dropped to the ground can be supplied to the collecting stand and the pitching machine, thereby enabling table tennis to be trained alone.

Further, the automatic table tennis training apparatus may include; a table tennis ball transfer device 200 located under the first court 102 to transfer the table tennis balls A dropped to the ground to the pitching machine 110 and having a housing 210 having a driving motor 240 located at the rear side thereof and upper and lower sprockets disposed on the front, upper and lower sides thereof to install first and second chains 230 and 231 thereon and trays 220 mounted on the second chain 231 at given intervals and having seating spaces 222 formed at the inside thereof, forks 223 formed on the front side thereof to lift up the table tennis ball A collected to a guide recess 136 formed at the center of the lower guide, and a discharge plate 224 located on the rear side thereof; and a supply path 300 for forming an inclined path from one side of top of the table tennis ball transfer device 200 to the collecting stand 120, while having both side walls, to supply the table tennis balls A transferred from the table tennis ball transfer device 200 to the collecting stand 120.

According to the present invention, the automatic table tennis training apparatus is provided with the pitching machine that automatically launches the table tennis balls, while adjusting the launch speeds, angles, and the like of the table tennis balls, so that training a variety of skills alone can be achieved and the training effectiveness can be improved.

Further, the automatic table tennis training apparatus is provided with the fence part, the blowing part, the transfer part, and the collecting stand that are adapted to automatically collect the table tennis balls dropped to the ground and to thus supply them to the pitching machine, so that there is no need to collect the table tennis balls scattered everywhere one by one.

In addition, the automatic table tennis training apparatus is provided with the sensing parts and the calculating part that provide the hitting scores of the player, so that the player can be excited during training.

DETAILED DESCRIPTION OF THE INVENTION

Figure 1:
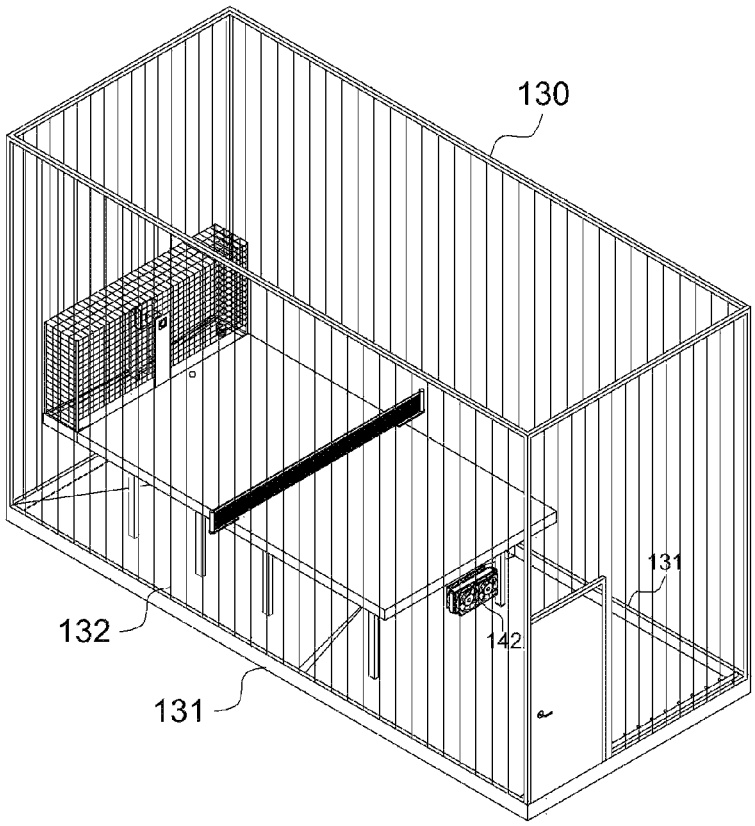
FIG. 1 is a perspective view showing an automatic table tennis training apparatus according to the present invention.

The present invention relates to an automatic table tennis training apparatus which includes: a rectangular table tennis table 100 which is divided into a first court 102 on one side thereof and a second court 103 on the other side thereof, with respect to a net 101 disposed vertically thereon in a width direction thereof, and has a height determined by support posts supporting the underside thereof; a pitching machine 110 which is located on an end portion of the first court 102 and launches, towards the second court 103, table tennis balls supplied sequentially thereto; a collecting stand 120 which is located on the end portion of the first court 102, collects the table tennis balls that have been transferred or dropped, and supplies the table tennis balls to the pitching machine 110; and a fence part 130 which includes a lower guide 131 located horizontally with respect to the ground and a net cage 132 provided upward from the lower guide 131, to thus form a space in which the table tennis table 100 is placed, to limit the range of the escape of the table tennis balls from the table tennis table 100, and to guide the movement directions of the table tennis balls dropped to the ground; a blowing part 140 which blows the table tennis balls dropped to the ground to move the table tennis balls towards one side end of the lower guide 131 located under the table tennis table 100; and a transfer part 150 which sucks the table tennis balls moved to one side end of the lower guide 131 to thus transfer the table tennis balls to the collecting stand 120.

Hereinafter, embodiments of the present invention will be explained in detail with reference to the attached drawings.

First, the table tennis table 100 has the shape of a table used really in table tennis games, and according to the regulations of international table tennis federation, desirably, the table has a dimension of width 152.5 cm×depth 274 cm×height 76 cm. However, the table tennis table 100 is not necessarily limited thereto.

As shown in FIG. 1, top of the table tennis table 100 is divided, with respect to the net 101 disposed vertically thereon in a width (horizontal) direction thereof, into the first court 102 on one side thereof and the second court 103 on the other side thereof, and a player who desires to perform table tennis training through the automatic table tennis training apparatus according to the present invention can hit table tennis balls toward the first court 102 in a state of being located by the second court 103.

In this case, the pitching machine 110 as a device for automatically receiving and launching table tennis balls is located on an end portion of the first court 102 to thus launch the table tennis balls towards the second court 103, and the launch point of the pitching machine 110 is desirably formed in the range of a height of 15.25 to 40 cm from the table tennis table 100 to allow the trajectories of the table tennis balls to be formed in diagonal directions in consideration of the height 15.25 cm of the net 101 and the height of the average hitting point in real games. However, the launch point of the pitching machine 110 is not necessarily limited thereto.

Further, the pitching machine 110 is desirably located on the center of the end portion of the first court 102, but it may be movable, without being fixed thereto. That is, the pitching machine 110 is movable to the left and right sides along a rail located in the width direction of the table tennis table 100 to thus launch the table tennis balls, and further, the pitching machine 110 can adjust a height of the launching point upward and downward within a given range and a launching angle in every direction within a given range, thereby controlling the landing points of the table tennis balls launched.

However, even in the case where the pitching machine 110 is movable to the left and right sides along the rail to thus launch the table tennis balls, the supply of the table tennis balls to the pitching machine 110 can be performed only when the pitching machine 110 is located on the center of the end portion of the first court 102.

In more specific, the pitching machine 100 includes a pitching part 111 having a plurality of rotary wheels spaced apart from one another to form an insertion hole into which the table tennis ball is inserted to thus launch the table tennis ball inserted into the insertion hole through the rotation of the rotary wheels, a supplying part 112 having an entry hole 113 formed on a lower portion thereof to allow the table tennis balls to enter the inside thereof and a transfer device disposed therein to transfer the table tennis balls upward through a transfer path along which the table tennis balls are transferred upward, and a pitching controller for controlling the rotary speeds of the rotary wheels to thus change the rotary speeds and directions of the table tennis balls launched.

Figure 2:
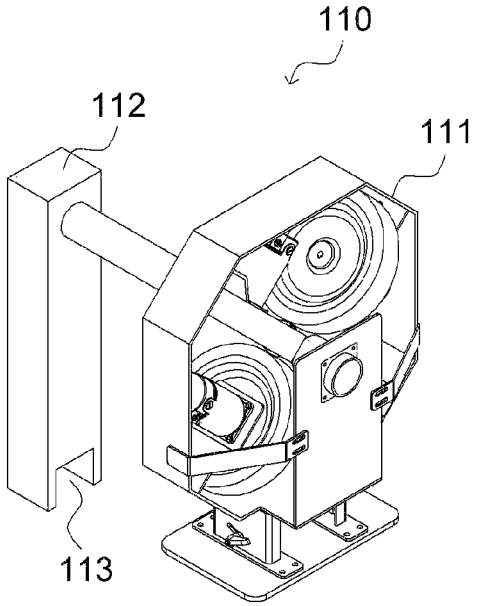
FIG. 2 is an exemplary perspective view showing a pitching machine of the automatic table tennis training apparatus according to the present invention.

Accordingly, the pitching part 111 may have two rotary wheels horizontally spaced apart from each other to form the insertion hole or three rotary wheels spaced apart from one another to the shape of Y to form the insertion hole, and as shown in FIG. 2, the pitching part 111 may have four rotary wheels spaced apart from one another to the shape of X to form the insertion hole. To allow the table tennis balls launched to provide various trajectories with various paths, in this case, the pitching part 111 may desirably have three or four rotary wheels.

If the pitching part 111 has three rotary wheels, the first rotary wheel is disposed vertically under the insertion hole, the second rotary wheel is disposed vertically above the left side of the insertion hole, and the third rotary wheel is disposed vertically above the right side of the insertion hole, and if the pitching part 111 may have four rotary wheels, the first rotary wheel is disposed slantly under the left side of the insertion hole, the second rotary wheel is disposed slantly under the right side of the insertion hole, the third rotary wheel is disposed slantly above the left side of the insertion hole, and the fourth rotary wheel is disposed slantly above the right side of the insertion hole.

Accordingly, the speeds and trajectories of the table tennis balls launched may be differently produced according to the rotary speeds of the respective rotary wheels constituting the pitching part 111, and according to an embodiment of the present invention in which the pitching part 111 has the four rotary wheels, if the first to fourth rotary wheels rotate in the same speeds as one another, the table tennis ball launched produces a straight line trajectory. If the rotary speeds of the first and second rotary wheels are faster than those of the third and fourth rotary wheels, further, the table tennis ball launched produces a downward trajectory, and if the rotary speeds of the third and fourth rotary wheels are faster than those of the first and second rotary wheels, further, the table tennis ball launched produces an upward trajectory.

Even though the rotary speeds of the first and second rotary wheels are faster than those of the third and fourth rotary wheels to allow the table tennis ball launched to produce the downward trajectory, the rotary speeds of the first and second rotary wheels are different from each other and the rotary speeds of the third and fourth rotary wheels are different from each other, thereby producing various trajectories of the table tennis balls.

Accordingly, the player who performs training through the automatic table tennis training apparatus can adjust the rotary speeds of the table tennis balls launched in accordance with his or her table tennis skills, thereby controlling the difficulty of training, and further, an input part (not shown) is disposed on the second court 103 by which the player is located, controls the pitching controller to allow the table tennis balls to be launched from the pitching machine 110, and adjusts the rotary speeds and trajectories of the table tennis balls launched.

In specific, the input part may include an input means, such as a button and the like, for driving the pitching machine 110 to allow the table tennis balls to be launched, an input means for adjusting the speeds of the table tennis balls launched, an input means for adjusting the trajectories of the table tennis balls launched, and an input means for adjusting the launch heights of the table tennis balls.

Further, the input part may include an input means for adjusting the launch angles of the table tennis balls, an input means for adjusting the launch intervals of the table tennis balls, and an input means for moving the pitching machine 110 to the left and right sides along the rail.

Accordingly, the signals received from the input means are transferred to the pitching controller so that the respective rotary speeds of the rotary wheels can be adjusted, but the input means may not be necessarily provided independently of each other. That is, one input means may perform some adjusting functions.

Further, the input part serves to transfer the plurality of signals generated by the input of the player to the pitching controller, so that the table tennis balls are launched to different speeds from the pitching machine 110 and it is possible that predetermined courses in which the table tennis balls are launched to different speeds may be performed.

Accordingly, the player who desires to perform the training through the automatic table tennis training apparatus pre-sets given inputs before the training to thus launch the table tennis balls by the number of predetermined times, for a predetermined period of time, to adjust the speeds and directions of the table tennis balls launched, and to perform the training with the predetermined courses, so that it is not necessary to input the launch of the table tennis balls through the input part whenever the table tennis balls are launched, thereby allowing the player to perform the training in free and convenient ways.

Further, as shown in FIG. 1, the collecting stand 120, which is located on the end portion of the first court 102 in such a manner as to be horizontal with respect to top of the table tennis table 100, includes a collecting recess 121 formed on top thereof in such a manner as to allow the underside thereof to be inclined toward the center thereof and a through hole 122 formed on one side thereof in such a manner as to pass through the top and underside thereof, so that the table tennis balls collected to the collecting stand 120 after escaping from the table tennis table 100 can be gently supplied to the pitching machine 110.

That is, the table tennis balls, which are collected to the collecting recess 121 formed on top of the collecting stand 120 and then moved to the entry hole 113 of the pitching machine 110, are balls supplied directly to the collecting recess 121 by the player, but after the table tennis ball has been initially supplied by the player, desirably, the table tennis balls collected to the collecting recess 121 are the table tennis balls dropped to the ground during the training using the automatic table tennis training apparatus.

In specific, the through hole 122 formed on one side of the collecting stand 120 allows the table tennis balls dropped to the ground during the training to pass through the collecting stand 120 and to be then transferred to the collecting recess 121 formed on top end of the collecting stand 120, and the collecting recess 121 whose underside is inclined to the center thereof enables the table tennis balls passing through the through hole 122 and thus moving thereto to gently move to the center of the collecting stand 120, thereby allowing the table tennis ball to enter the entry hole 113 of the pitching machine 110.

Further, it is desirable that the movable range of the table tennis balls dropped to the ground during the training using the automatic table tennis training apparatus is restricted to prevent the table tennis balls from being lost and to enable them to be easily collected to the collecting stand 120, and to do this, as shown in FIG. 1, the fence part 130 includes the lower guide 131 located horizontally with respect to the ground and the net cage 132 provided upward from the lower guide 131, so that the fence part 130 forms a space in which the table tennis table 100 is placed, limits the escape range of the table tennis balls, and guides the movement directions of the table tennis balls dropped to the ground.

In specific, the lower guide 131 includes a pair of side guides spaced apart from each other in parallel with each other and a pair of end guides connecting one side end and the other side end of the pair of side guides, and a rectangular floor formed by the pair of side guides and the pair of end guides is utilized as the space in which the table tennis table 100 is built and the player moves during training.

In this case, a pair of diagonal or curve guides is connected to each other toward the inside of the fence part 130 from the intermediate portion of the pair of side guides to allow the table tennis balls moving under the table tennis table 100 after dropped to the ground to be collected to a given place, and further, a pair of auxiliary guides is connected in parallel to each other from one side end of the pair of diagonal or curve guides to provide a moving path along which the table tennis balls move.

Figure 3:
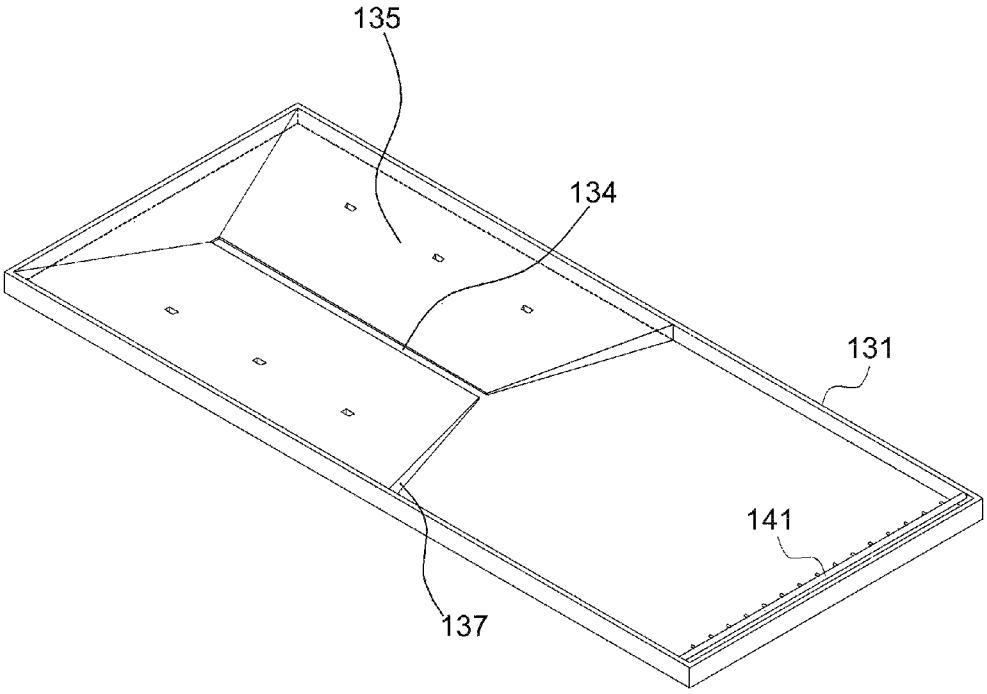
FIG. 3 is an exemplary perspective view showing a lower guide of the automatic table tennis training apparatus according to the present invention.

Further, as shown in FIG. 3, the fence part 130 includes a pair of guide plates 135 formed on the floor under the table tennis table 100 in such a manner as to allow both sides thereof along the longitudinal direction of the lower guide 131 to be inclined towards the center thereof to thus move the table tennis balls dropped to the ground to the center thereof, and so as to collect the moving table tennis balls, a straight line slot 134 is formed at the center of the pair of guide plates 135 to have a larger diameter than the table tennis ball. So as to allow the table tennis balls dropped behind the second court 103 to move to the straight line slot 134 by means of the blowing part 140, further, the guide plates 135 have side surfaces 137 inclined toward the first court 102 from the second court 103 in the direction of the straight line slot 134, so that the table tennis balls enter the interior of the straight line slot 134 through the air generated from the blowing part 140. So as to allow the table tennis balls that enter the straight line slot 134 to move toward the transfer part, further, a blowing fan 142 is disposed under the second court 103 to control the moving directions of the table tennis balls.

Also, the net cage 132 is configured to block the table tennis balls so that the table tennis balls launched from the pitching machine 110 or dropped to the ground after hit by the player can be located only inside the fence part 130, and the net cage 132 may be replaced with a transparent plate.

Further, as shown in FIG. 1, the blowing part 140, which is located inside the fence part 130, blows air to one side end of the lower guide 131 under the table tennis table 100 to thus move the table tennis balls dropped to the ground, and the table tennis balls moving by the blowing part 140 are collected under the table tennis table 100 through the lower guide 131.

Figure 4:
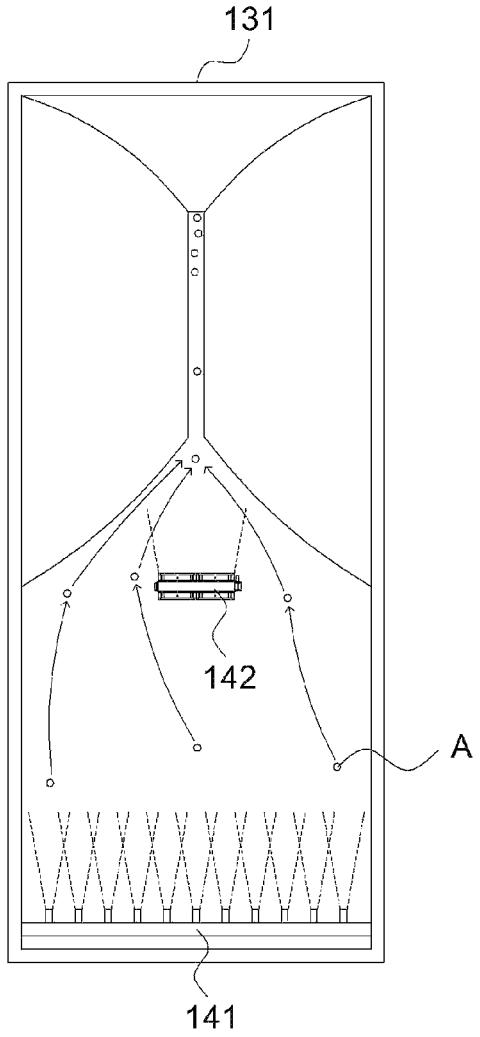
FIG. 4 is an exemplary view showing a situation in which a table tennis ball moves by a blowing part of the automatic table tennis training apparatus according to the present invention.

In specific, the blowing part 140 includes an air injection line 141 disposed on the other side end of the lower guide 131 to blow air to one side end of the lower guide 131 located in the opposite direction thereto, and as shown in FIG. 4, the air injection line 141 supplies air in a horizontal direction along the ground to allow the table tennis balls to move toward the table tennis table 100.

Further, the blowing part 140 includes one or more blowing fans 142 located under the table tennis table 100 to blow air in the same direction with the air injection line 141, and the blowing fans 142 serve to help the air injection line 141 so that the table tennis balls can move.

In this case, the air injection line 141 blows air in the horizontal direction to the ground from a height coming into contact with the ground, thereby preventing the air supplied therefrom from interrupting the player who performs the training through the automatic table tennis training apparatus, and the blowing fans 142 are located under the table tennis table 100, thereby giving no interruption to the player who trains table tennis.

While the air injection line 141 is blowing air in the horizontal direction to the ground from the height coming into contact with the ground, further, the air injection line 141 is configured to blow air to the sides of the lower guide 131 to allow the table tennis balls moving through the air to be transferred along the sides of the lower guide 131, thereby preventing the player who trains table tennis from stepping on the table tennis balls and falling down, and the blowing fans 142 are configured to repeatedly perform the rotation around an axis at a given angle.

Further, the fence part 130 has an openable entrance door located on one side thereof so that the player freely enters the inside thereof, while the table tennis balls during the training are being prevented from escaping from the inside thereof.

Figure 5:
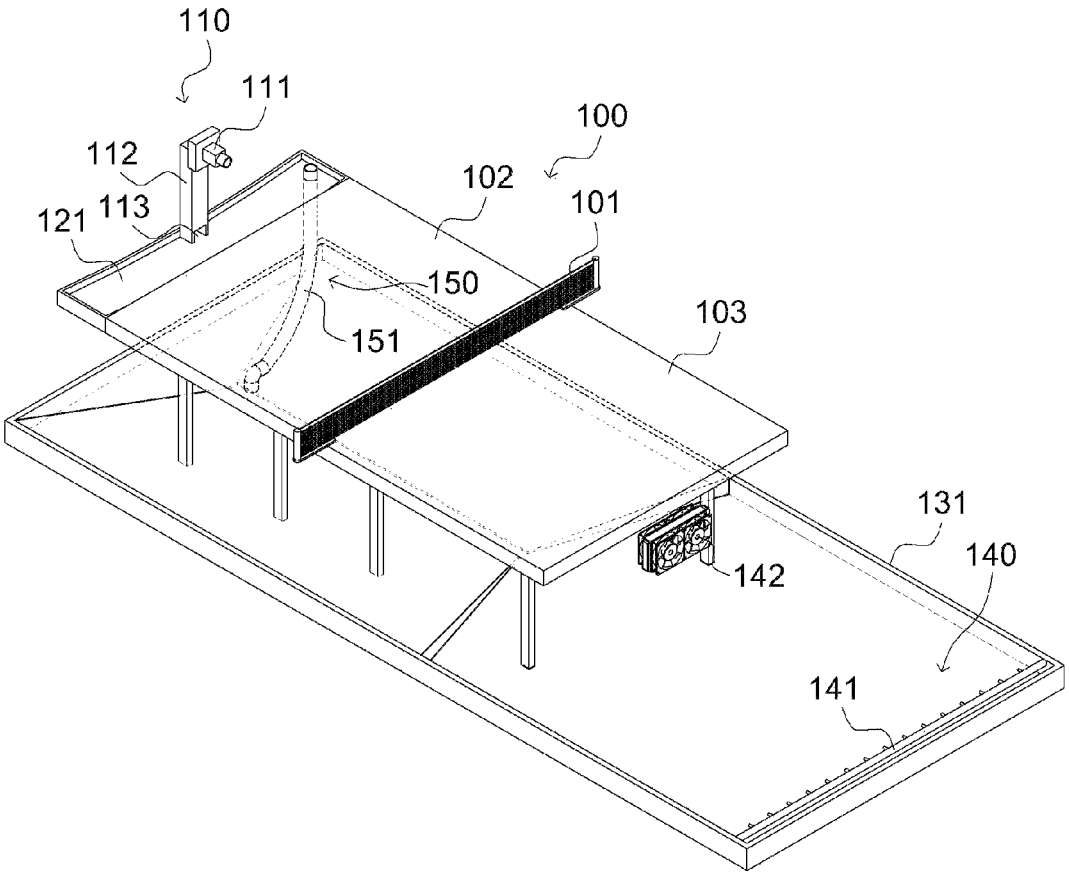
FIG. 5 is an exemplary perspective view showing a transfer unit of the automatic table tennis training apparatus according to the present invention.

Further, as shown in FIG. 5, the transfer part 150 is located on one end portion of the straight line slot 134 formed on the underside of the first court 102 of the table tennis table 100 to thus suck the table tennis balls through a pressure difference, so that the transfer part 150 transfers the table tennis balls collected under the table tennis table 100 to the collecting stand 120.

In specific, the transfer part 150 includes one or more sensors for sensing the table tennis balls moving to one side end of the lower guide 131, a transfer hose 151 having an inlet formed on one side end thereof toward one side end of the lower guide 131 and an outlet formed on the other side end thereof in such a manner as to pass through the through hole 122 formed on one side of the collecting stand 120 or fitted to the through hole 122, and a suction device for forming the pressure difference between the inside and outside of the transfer hose 151 if the table tennis balls are sensed by means of the sensors. In this case, the transfer part 150 operates to transfer the table tennis balls only when the table tennis balls are sensed by means of the sensors.

In this case, the sensors include a motion sensor for sensing motions or positions of objects, ultrasonic sensors for sensing distances from objects, and the like, but only if sensors may sense the table tennis balls moving to one side end of the lower guide 131, they may be freely adopted.

Figure 6:
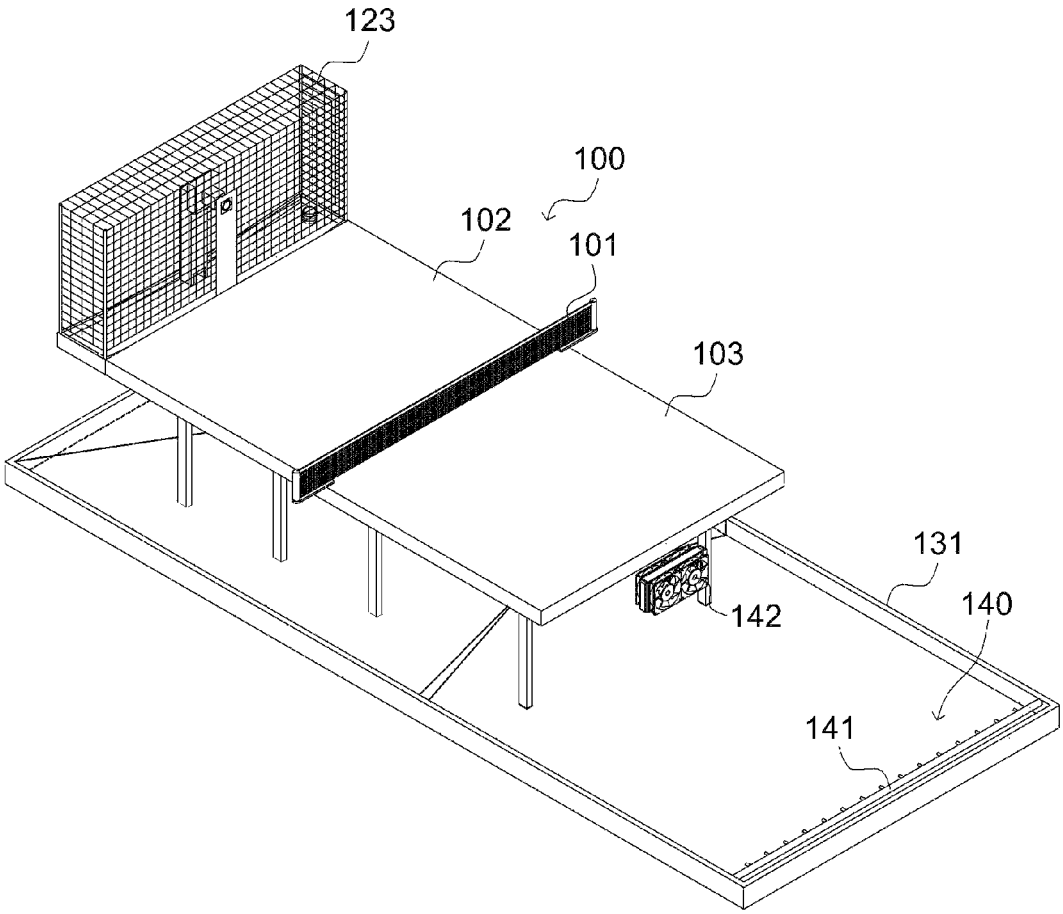
FIG. 6 is an exemplary perspective view showing an input part and a display device of the automatic table tennis training apparatus according to the present invention.

According to the characteristics of the transfer part 150 using the suction of the table tennis balls by the pressure difference, however, the table tennis balls, which are transferred to the collecting stand 120 through the transfer part 150, may be lifted up to a given height even after passing through the through hole 122, so that the table tennis balls may escape from the collecting stand 120, and even after dropped, they may collide against the collecting stand 120 or other table tennis balls and thus escape from the collecting stand 120. Accordingly, as shown in FIG. 6, an auxiliary fence part 123 is located on top of the entire collecting stand 120 or a portion of the collecting stand 120 to allow the table tennis balls to be seated onto the collecting recess 121 formed on top of the collecting stand 120, thereby preventing the table tennis balls from escaping from the collecting stand 120.

Figure 7:
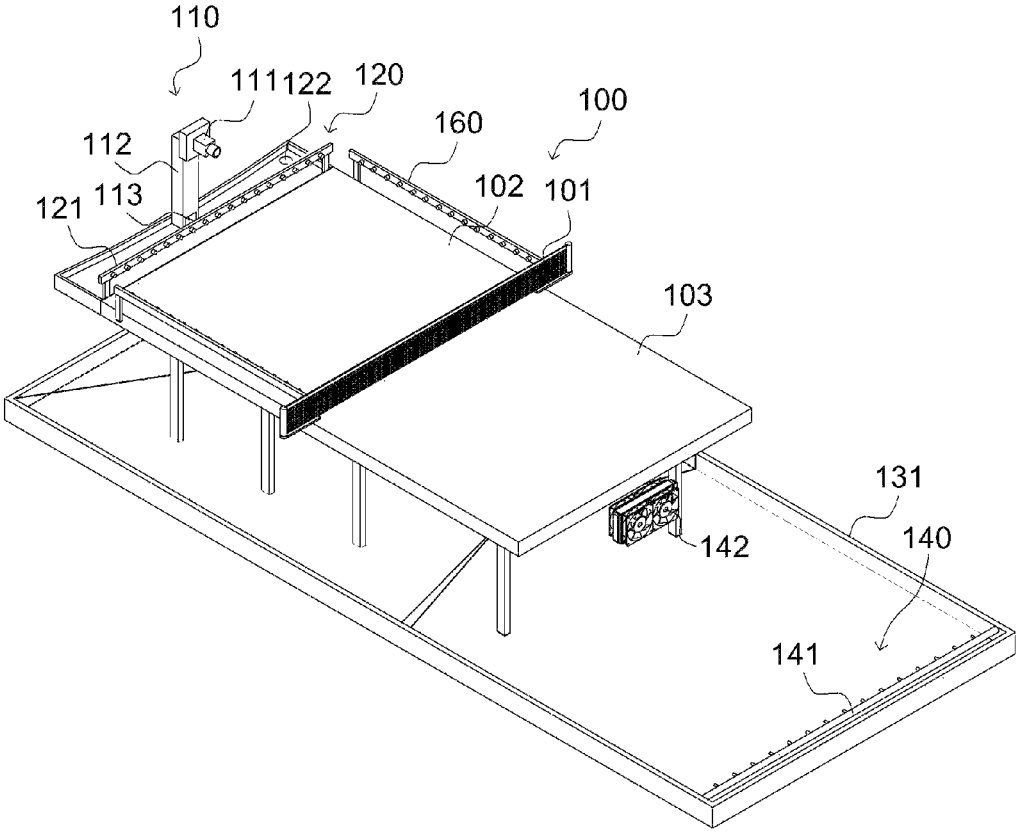
FIG. 7 is an exemplary perspective view showing a state where sensing parts are installed on the automatic table tennis training apparatus according to the present invention.
Figure 8:
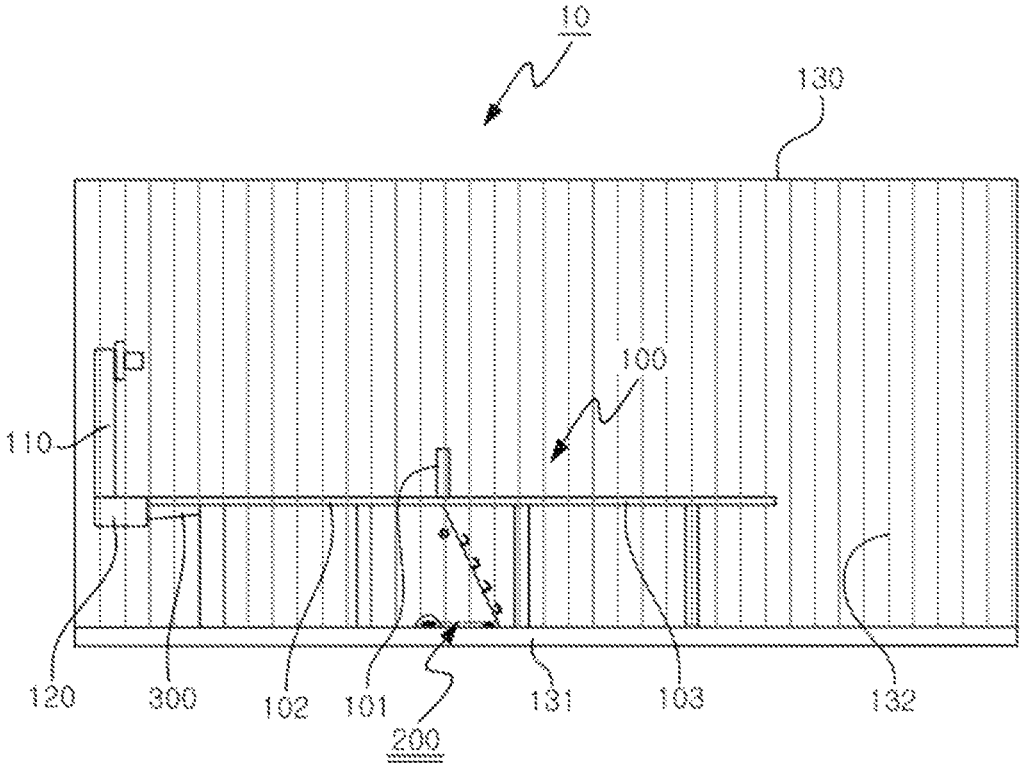
FIG. 8 is an exemplary view showing a state where a table tennis ball transfer device is installed on the automatic table tennis training apparatus according to the present invention.

Further, as shown in FIG. 7, the automatic table tennis training apparatus includes sensing parts 160 for sensing initial collision points of the table tennis balls hit by the player after the table tennis balls are launched from the pitching machine 110 against top of the first court 102 and a calculating part for calculating the hitting scores of the player based on the initial collision points sensed, and to allow the player's hitting scores calculated by the calculating part to be checked in real time by the player during the training, as shown in FIG. 8, a display device (not shown) is disposed on one side of the table tennis table 100, one side of the fence part 130, or any place of the fence part 130 to display the hitting scores on a screen thereof.

According to an embodiment of the present invention, the sensing parts 160 may include a plurality of laser sensors spaced apart from one another on one side end or both side ends of both left and right side ends (direction of X) of the first court 102 and both front and back side ends (direction of Y) and a plurality of laser sensors located on any one side section of both side ends of the first court 102 in the directions of X and Y or may include a plurality of laser sensors spaced apart from one another by a given distance on both side ends of the first court 102 in the directions of X and Y, so that the sensing parts 160 are located in the directions of X and Y.

In this case, the distances of the first laser sensor part and the second laser sensor part from the surface of the first court 102 are desirably in the range of 50 to 60 mm in consideration of the diameter of about 40 mm of the table tennis ball, and the distance between the respective laser sensor is about 3 cm. Further, the sensing parts 160 may include a measuring part for measuring the speeds of the table tennis balls hit by the player.

Under the above-mentioned configuration, the calculating part senses the accurate initial collision points of the table tennis balls against top of the first court 102 through the values sensed by the first laser sensor part and the second laser sensor part and thus calculates the hitting scores of the player, based on the sensed initial collision points. In the calculation of the hitting scores, any one or more pieces of information of the launch speeds, directions and angles of the table tennis balls from the pitching machine 110 may be included.

Further, according to an embodiment of the present invention, the sensing parts 160 may include a first camera for photographing the directions of table tennis balls in the direction of X on the front or rear side of the table tennis table 100 and a second camera for photographing the initial collision of the table tennis balls against top of the first court 102 in the direction of Y on any one side of both sides of the table tennis table 100, and further, the sensing parts 160 may include a measuring part for measuring the speeds of the table tennis balls hit by player.

In this case, like the second camera for photographing the initial collision of the table tennis balls against top of the first court 102, desirably, the first camera may photograph the collision of the table tennis balls at the same height as top of the table tennis table 100, but in the direction of X on the front or rear side of the table tennis table 100, the pitching machine 110, the auxiliary fence part 123, and the player may interrupt the photographing. Accordingly, the first camera is disposed at a higher position than top of the table tennis table 100 to photograph only the directions of the table tennis balls.

Under the above-mentioned configuration, the calculating part senses the accurate initial collision points of the table tennis balls against top of the first court 102 through the images photographed by the first camera and the second camera and thus calculates the hitting scores of the player, based on the sensed initial collision points. In the calculation of the hitting scores, any one or more pieces of information of the launch speeds, directions and angles of the table tennis balls from the pitching machine 110 may be included.

Further, the calculation of the hitting scores through the calculating part may include the time from the launch of the table tennis balls from the pitching machine 110 to the initial collision against top of the first court 102 and the speeds, directions or angles of the table tennis balls hit by the player, and the speeds, directions or angles of the table tennis balls hit by the player are analyzed through the images photographed.

In addition, the display device displays the accumulated hitting scores of the player that are provided through the calculation of the calculating part, the average hitting score calculated for the number of predetermined times such as 10 or 20 times, any one or more pieces of information of the launch speeds, angles and trajectories of the table tennis balls from the pitching machine 110, information of training time of the player and difficulty of training, and other inputs or options.

Further, auxiliary sensing parts may be provided on the second court 103 with the same or similar configuration as or to the sensing parts 160 to sense the initial collision points of the table tennis balls, and the calculating part calculates the receiving scores of the player, based on the initial collision points sensed. In the calculation of the hitting point, any one or more pieces of information of the launch speeds, directions and angles of the table tennis balls from the pitching machine 110 may be included.

Also, the display device may have a function of outputting voices or sounds therefrom or may be connected to an output device for outputting voices or sounds, and the display device or the output device outputs voices or effect sounds according to the hitting scores or receiving scores of the player that are calculated by the calculating part.

To allow players who desire to train table tennis using the automatic table tennis training apparatus to compete with one another in the same conditions, further, one or more competition modes may be provided, and any one of the competition modes is selected by the player through the input part to collect his or her score related to the competition mode.

To provide the same conditions to all of the players who compete with one another through the competition modes, however, changes of the positions, directions, angles and speeds of the table tennis balls launched sequentially are not always provided in the same manner. That is, the order of the changes may be differently provided, and while a given difficulty is being kept, it may be differently provided every time.

In this case, the display device may display the score of the player who currently trains table tennis, the daily highest score collected from 0:00 am to 23:59 pm, the weekly highest score collected from Monday to Sunday or from Sunday to Saturday, the monthly highest score collected from the first date of a month to the last date of the month, or the yearly highest score collected from January 1st to December 31st.

One or more game modes may be provided to the player who desire to train table tennis using the automatic table tennis training apparatus, and any one of the game modes is selected by the player through the input part to collect his or her score.

According to an embodiment of the present invention related to the game modes, the table tennis balls may be launched, to the player who selects the given game mode, with a very easy difficulty level for one minute, with an easy difficulty level for one minute, with a normal difficulty level for one minute, with a hard difficulty level for one minute, and with a very hard difficulty level for one minute, sequentially.

In this case, in the game mode, the table tennis balls are launched, while the difficulty levels are being changed only by the elapse of time, irrespective of the player's score, but only when the player acquires the score over the reference score by difficulty level, the next difficulty level is provided. Further, rest time for several seconds may be provided between the levels, and during the rest time, designated comments may be outputted.

According to another embodiment of the present invention, an automatic table tennis training apparatus 10 includes: a rectangular table tennis table 100 which is divided into a first court 102 on one side thereof and a second court 103 on the other side thereof, with respect to a net 101 disposed vertically thereon in a width direction thereof, and has a height determined by support posts supporting the underside thereof; a pitching machine 110 which is located on an end portion of the first court 102 and launches, towards the second court 103, table tennis balls A supplied sequentially thereto; a collecting stand 120 which is located on the end portion of the first court 102, collects the table tennis balls A that have been transferred or dropped, and supplies the table tennis balls A to the pitching machine 110; and a fence part 130 which includes a lower guide 131 located horizontally with respect to the ground and a net cage 132 provided upward from the lower guide 131, to thus form a space in which the table tennis table 100 is placed, to limit the escape of the table tennis balls A, and to guide the movement directions of the table tennis balls A dropped to the ground; a table tennis ball transfer device 200 located under the first court 102 to transfer the table tennis balls A dropped to the ground to the pitching machine 110; and a supply path 300 for supplying the table tennis balls A transferred from the table tennis ball transfer device 200 to the collecting stand 120.

Top of the table tennis table 100 is divided, with respect to the net 101 disposed vertically thereon in a width (horizontal) direction thereof, into the first court 102 on one side thereof and the second court 103 on the other side thereof, and a player who performs table tennis training through the automatic table tennis training apparatus 10 according to the present invention can hit the table tennis balls A toward the first court 102 in a state of being located by the second court 103.

In this case, the pitching machine 110 as a device for automatically receiving and launching the table tennis balls A is located on an end portion of the first court 102 to thus launch the table tennis balls A towards the second court 103.

In specific, the pitching machine 100 includes a pitching part 111 having a plurality of rotary wheels spaced apart from one another to form an insertion hole into which the table tennis ball A is inserted to thus launch the table tennis ball A inserted into the insertion hole through the rotation of the rotary wheels, a supplying part 112 having an entry hole 113 formed on a lower portion thereof to allow the table tennis balls A to enter the inside thereof and a transfer device disposed therein to transfer the table tennis balls A upward through a transfer path along which the table tennis balls A are transferred upward, and a pitching controller for controlling the rotary speeds of the rotary wheels to change the rotary speeds and directions of the table tennis balls A launched.

The collecting stand 120, which is located on the end portion of the first court 102, includes a collecting recess 121 whose underside is inclined toward the center thereof and a supply hole 122 formed on the center of the front side thereof in such a manner as to be connected to the supply path 300 to supply the table tennis balls A to the collecting recess 121, so that the table tennis balls A collected to the collecting stand 120 after they have escaped from the front side of the table tennis table 100 can be gently supplied to the pitching machine 110.

To allow the table tennis balls A dropped to the ground during the training to be easily collected to the collecting stand 120, further, the fence part 130 includes the lower guide 131 located horizontally with respect to the ground and the net cage 132 provided upward from the lower guide 131, so that the fence part 130 forms a space in which the table tennis table 100 is placed, limits the escape ranges of the table tennis balls A, and guides the movement directions of the table tennis balls A dropped to the ground, thereby restricting the movable ranges of the table tennis balls A to the outside thereof.

Figure 9:
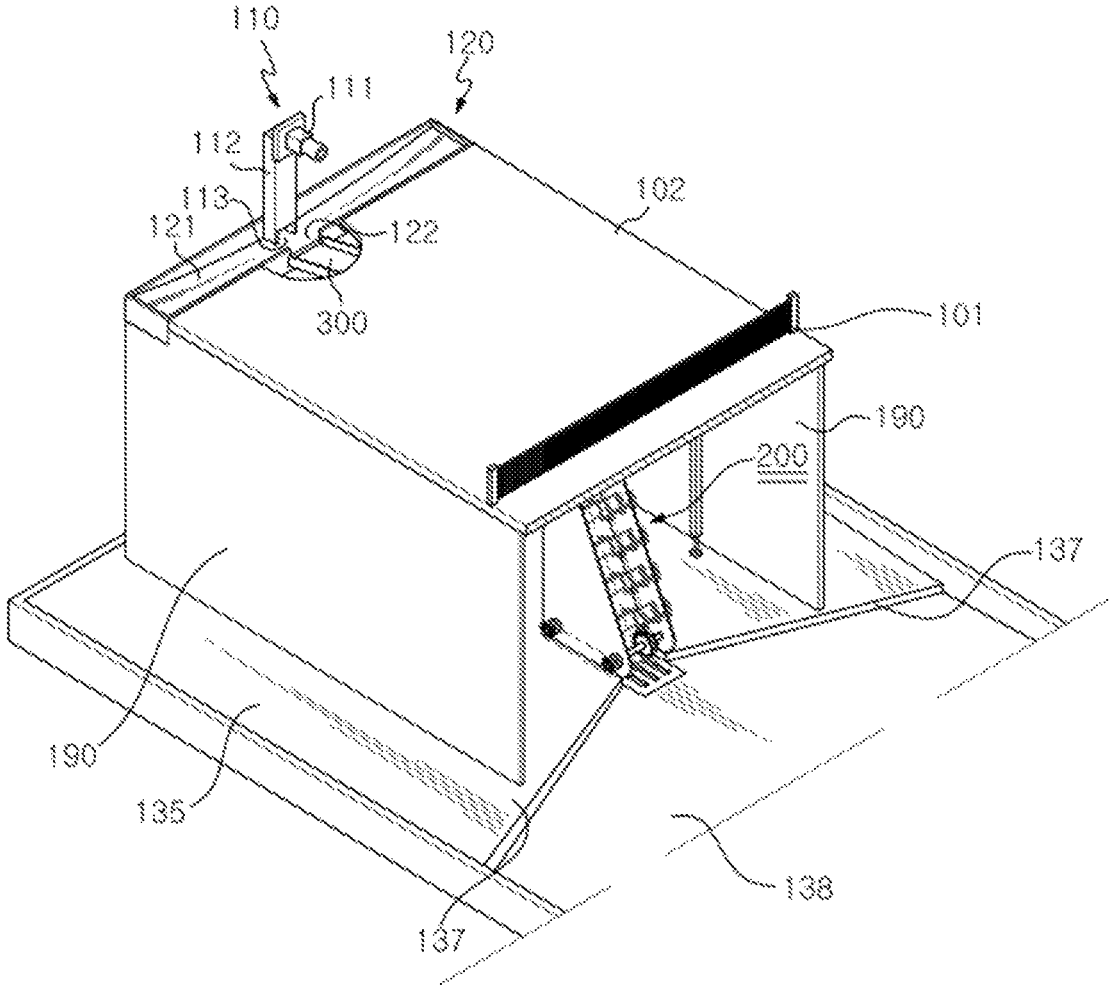
FIG. 9 is an exemplary perspective view showing a collecting stand of the automatic table tennis training apparatus according to the present invention.
Figure 10:
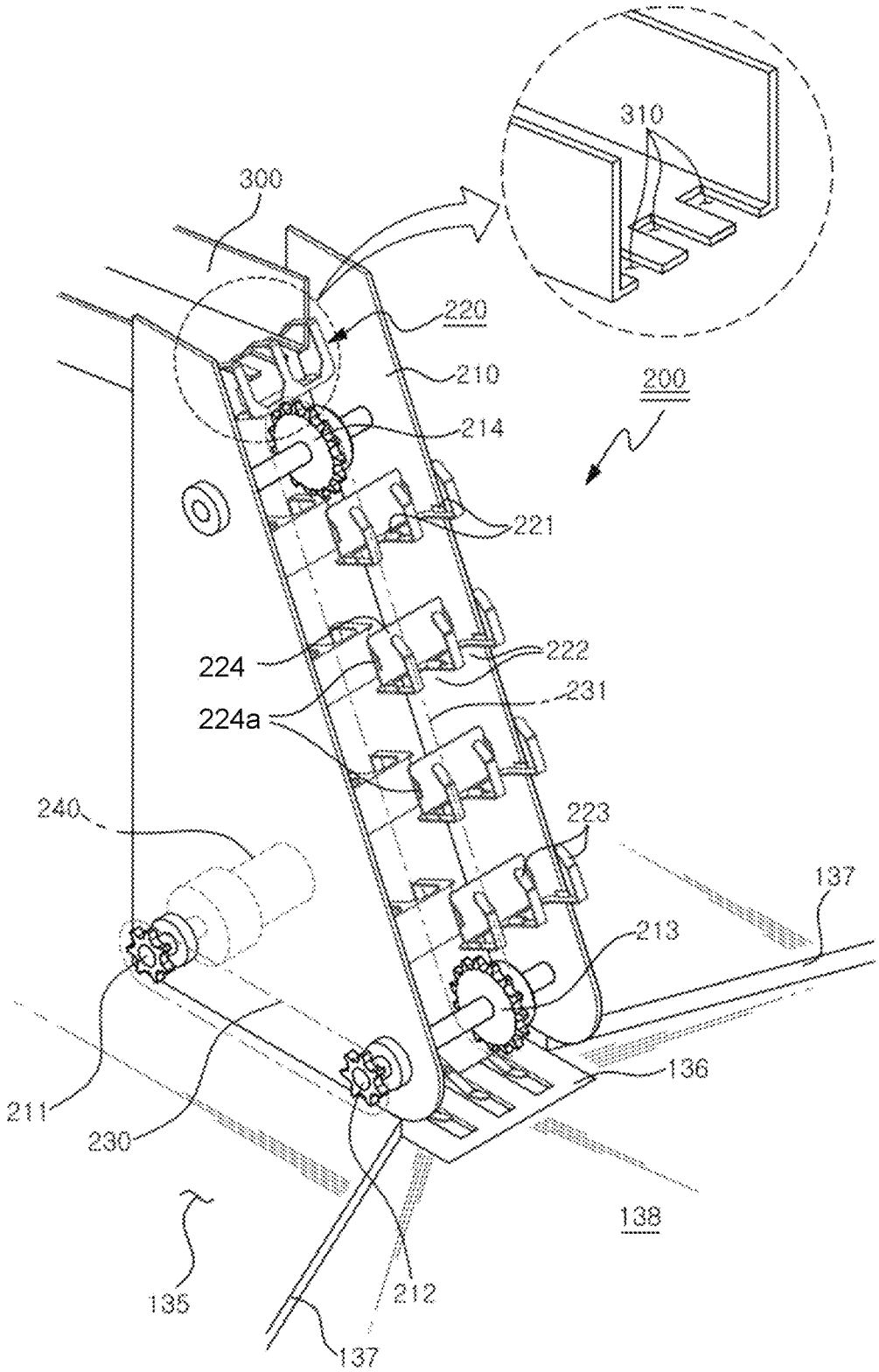
FIG. 10 is a perspective view showing the table tennis ball transfer device of the automatic table tennis training apparatus according to the present invention.
Figure 11:
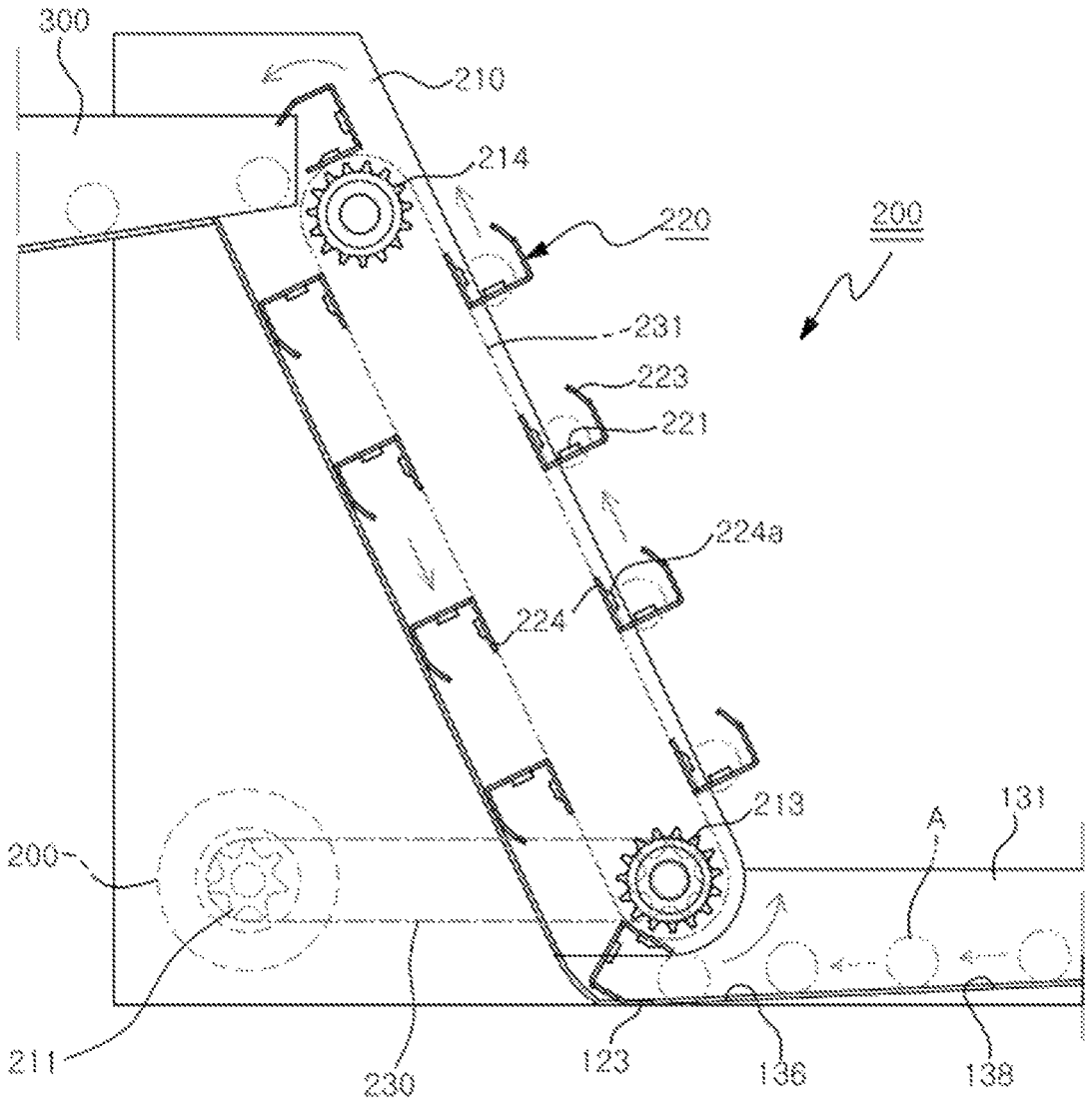
FIG. 11 is a side sectional view showing the table tennis ball transfer device of the automatic table tennis training apparatus according to the present invention.
Figure 12:
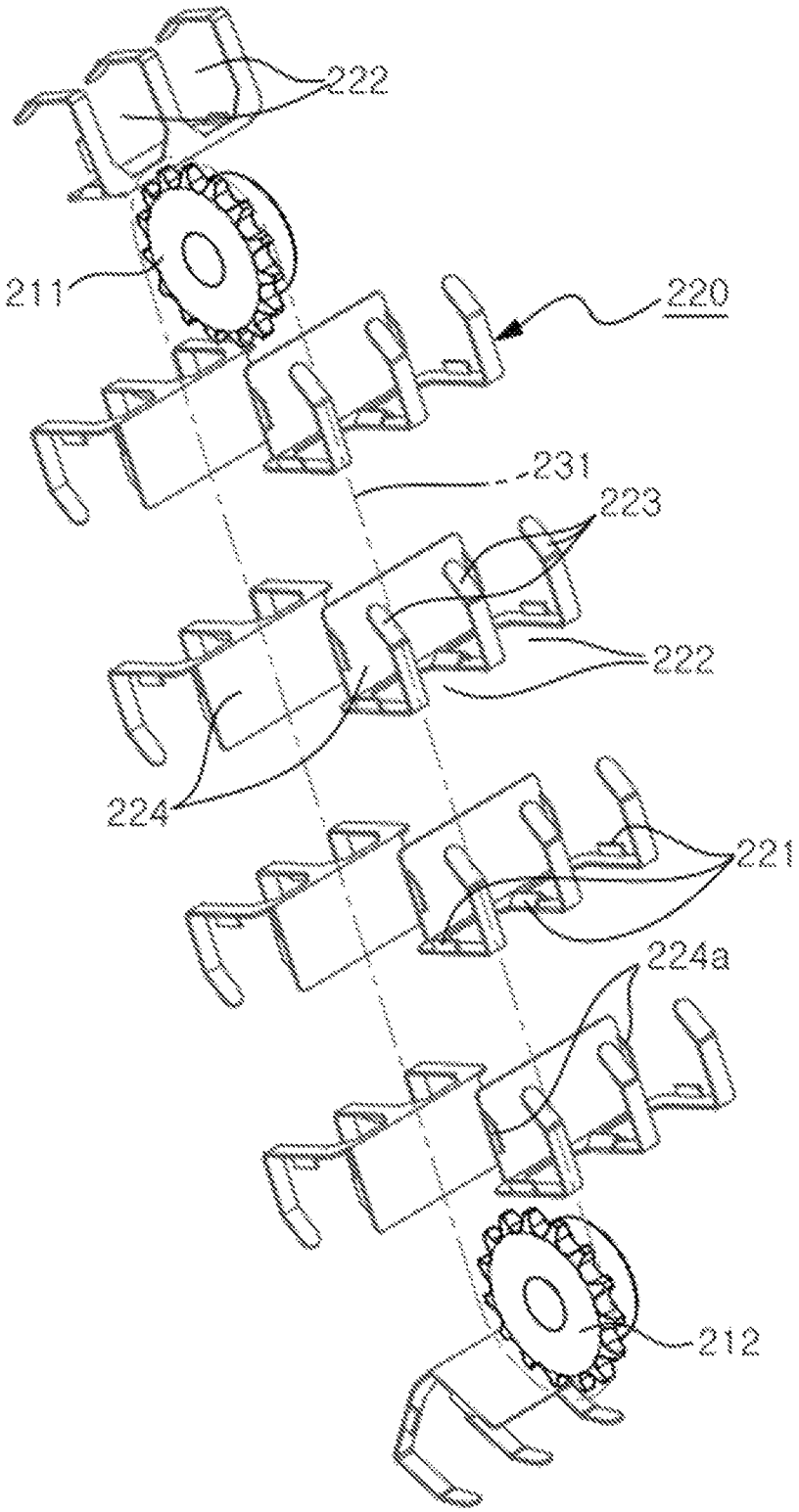
FIG. 12 is a perspective view showing a state where trays are coupled to a chain.
Figure 13:
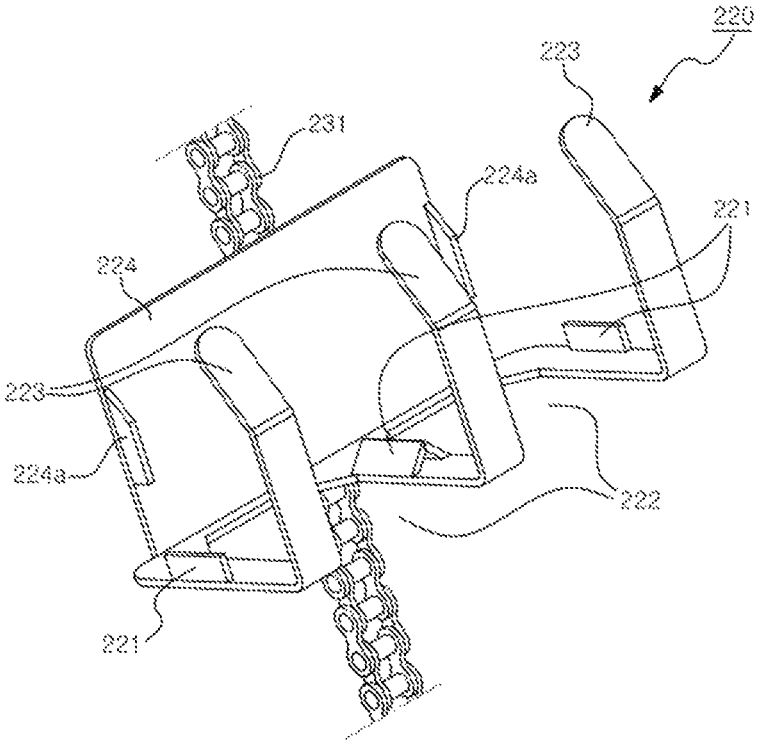
FIG. 13 is a perspective view showing a configuration of the tray.

As shown in FIGS. 9 and 10, the fence part 130 includes a pair of first guide plates 135 formed on the floor under the first court 102 in such a manner as to be inclined toward the second court 103 from the first court 102 to allow the table tennis balls A dropped to the left and right sides of the first court 102 to be collected to the table tennis ball transfer device 200 and a guide recess 136 formed at the center of the first guide plates 135 to allow the table tennis balls A to be collected thereto.

When the table tennis balls A dropped to the left and right sides of the first court 102 are collected to the table tennis ball transfer device 200, to prevent the table tennis balls A from being distributed to a portion behind the table tennis ball transfer device 200 under the table tennis table 100 thus to fail to gently collect the table tennis balls A, guide plates 190 are located on both side surfaces of the table tennis table 100. The guide plates 190 are extended to ends of the first guide plates 135, and if necessary, they may be extended to the second court 103.

As shown in FIG. 10, the fence part 130 has the pair of first guide plates 135 formed on the floor under the first court 102 in such a manner as to be inclined toward the second court 103 from the first court 102 to allow the table tennis balls A dropped to the left and right sides of the first court 102 to be collected to the table tennis ball transfer device 200 and the guide recess 136 formed on the front sides of the first guide plates 135 as the center between the first guide plates 135 to allow the table tennis balls to be collected to move to the collecting stand 120 through the table tennis ball transfer device 200.

Further, the fence part 130 includes a second guide plate 138 inclined toward the first court 102 from the second court 103 to allow the table tennis balls A dropped to the second court 103 to move to the guide recess 136, so that the table tennis balls A can enter the guide recess 136.

Further, the first guide plates 135 have side surfaces 137 adapted to allow the ends of the first guide plates 135 inclined toward the second court 103 from the first court 102 to be higher than the ends of the second guide plate 138 inclined toward the first court 102 from the second court 103.

The side surfaces 137 are slant toward the guide recess 136 from the lower guide 131 so that the table tennis balls A easily enter the guide recess 136.

The table tennis ball transfer device 200 is located on one side surface of the guide recess 136 to supply the table tennis balls A dropped to the ground to the pitching machine 110, and the installation position of the table tennis ball transfer device 200 may be located on the ground under the table tennis table 100 between the first court 102 and the second court 103. The table tennis ball transfer device 200 includes: a housing 210 having a driving motor 240 located at the rear side thereof and upper and lower sprockets disposed on the front, upper and lower sides thereof to install first and second chains 230 and 231 thereon; and trays 220 mounted on the chain 231.

The housing 210 includes the driving motor 240 located at the rear side thereof, the first sprocket 211 mounted on the shaft of the driving motor 240, the second sprocket 212 located on the lower portion of the front side thereof and connected to the first sprocket 211 through the first chain 230, the third sprocket 213 located on the lower portion of the front side thereof, and the fourth sprocket 214 located on the upper portion of the front side thereof and connected to the third sprocket 213 through the second chain 231, so that the first and second chains 230 and 231 rotate endlessly around the sprockets by means of the driving motor 240.

The trays 220 are mounted on the second chain 231 at given intervals to transfer the table tennis balls A to the pitching machine 110.

Each tray 220 has the shape of 'U' so that the table tennis ball A is transferred upward in the state of being seated thereonto and includes guide protrusions 221 protruding from both sides thereof and the inner center thereof, seating spaces 222 formed at the inside thereof at given intervals to seat the table tennis ball A thereonto, forks 223 formed on the front side thereof to lift up the table tennis ball A collected to the guide recess 136 of the automatic table tennis training apparatus and to thus induce the table tennis ball A to the seating spaces 222, and a discharge plate 224 located on the rear side thereof.

The guide recess 136 to which the table tennis balls A are collected is formed to allow the forks 223 of the trays 220 to pass therethrough, while inserting the forks 223 thereinto, and to allow the table tennis balls A to be then induced to the interiors of the trays 220 after the table tennis balls A have come into contact with the ends of the forks 223.

Figure 14:
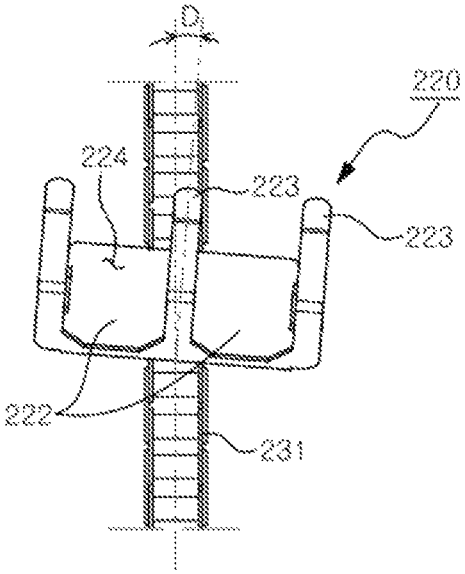
FIG. 14 is a front view of the tray.
Figure 15:
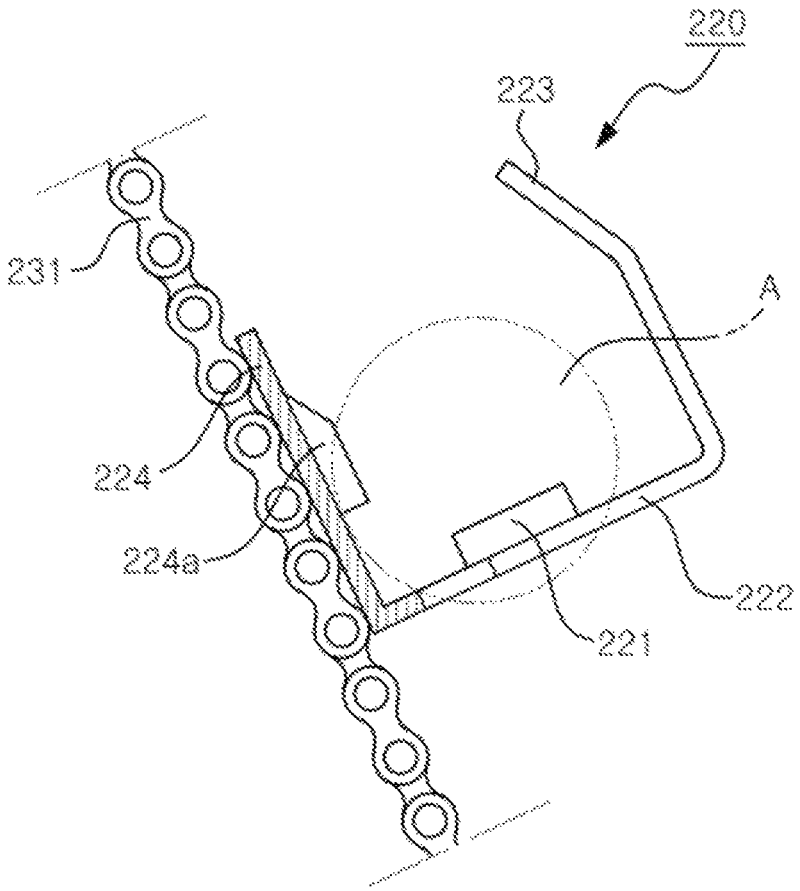
FIG. 15 is a side view of the tray.

When each tray 220 is coupled to the second chain 231, as shown in FIG. 14, the tray 220 is installed tilted by a given angle D to one side from the center of the second chain 231 so that other table tennis balls A except the table tennis ball A seated on the seating spaces 222 of the tray 220 are dropped to the guide recess 136, thereby preventing two or more table tennis balls A from being transferred to the pitching machine 110.

The ends of the forks 223 are bent inward toward the second chain 231 so that as the tray 220 reaches the third sprocket 213, the ends of the forks 223 come into contact with the bottom surface of the guide recess 136, and from the position where the forks 223 are close to the third sprocket 213 and the bottom surface of the guide recess 136 to the maximum, the ends of the forks 223 are slowly lifted up so that the table tennis ball A rolls to the interior of the tray 220 and is then seated onto the seating spaces 222 of the tray 220.

Further, each tray 220 includes escape prevention inducing plates 224*a* located on both sides of the discharge plate 224 to allow the table tennis ball A to be guided to the supply path 300, without escaping therefrom, when the table tennis ball A is discharged to the supply path 300 connected to the pitching machine 110.

Figure 16:
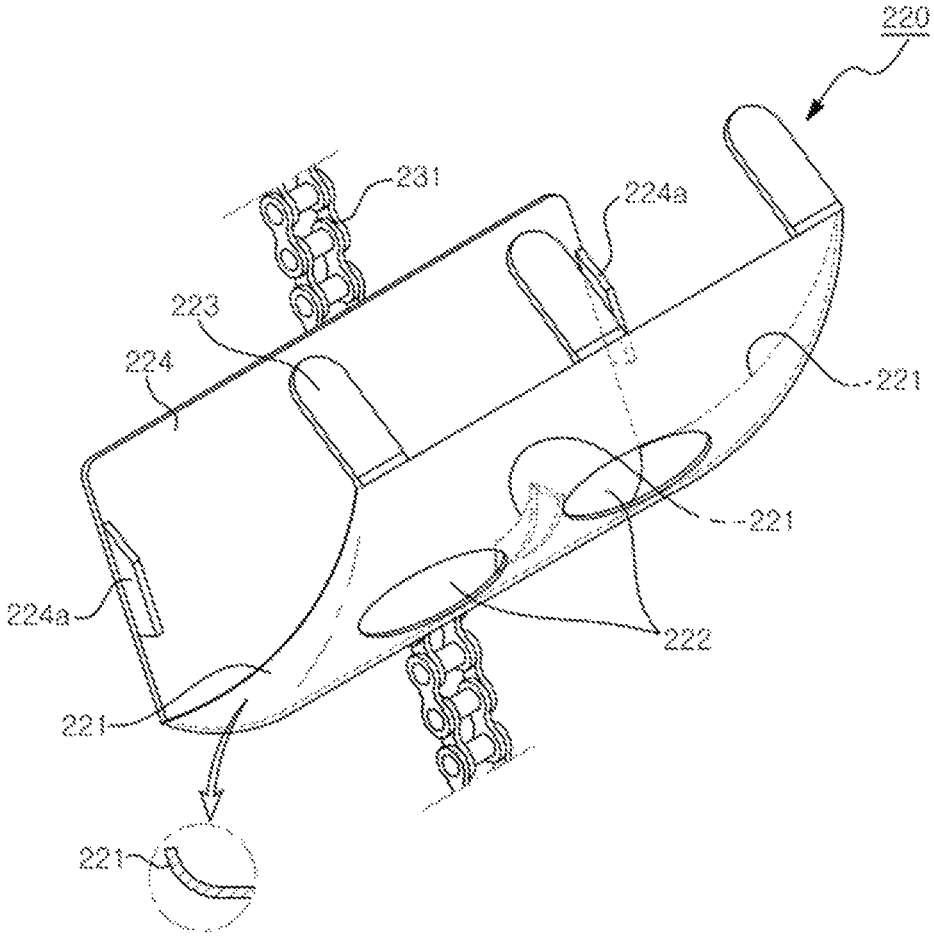
FIG. 16 is a perspective view showing another example of the tray.
Figure 17:
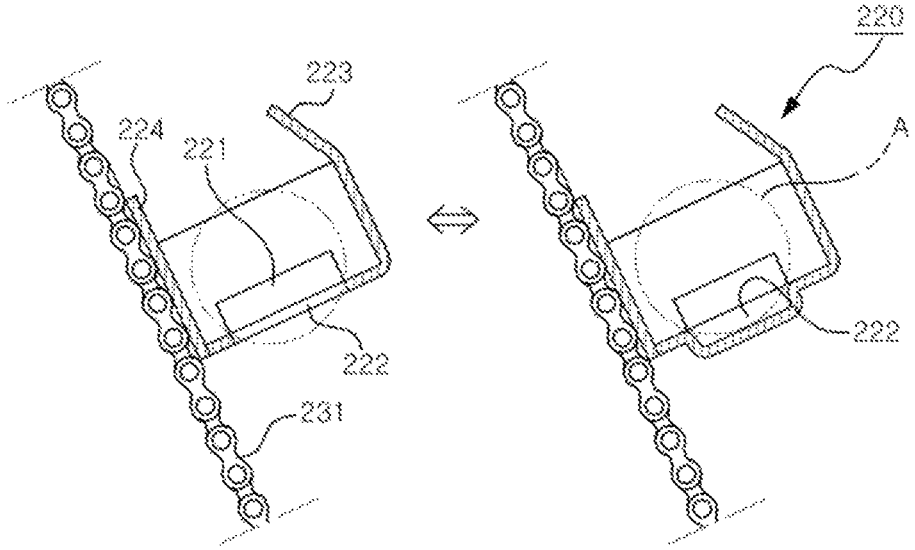
FIG. 17 is a side sectional view showing another example of the tray.

FIG. 16 is a perspective view showing another example of the tray, and FIG. 17 is a side sectional view showing another example of the tray.

As shown in FIG. 16, each tray 220 as another example has the shape of an arch-like plate on the section thereof and includes one or more seating spaces 222 concaved downward or punched on the inside thereof to seat the table tennis ball A thereonto and forks 223 formed on the front side thereof to induce the table tennis ball A to the seating spaces 222 and having ends bent inward toward the second chain 231.

Figure 18:
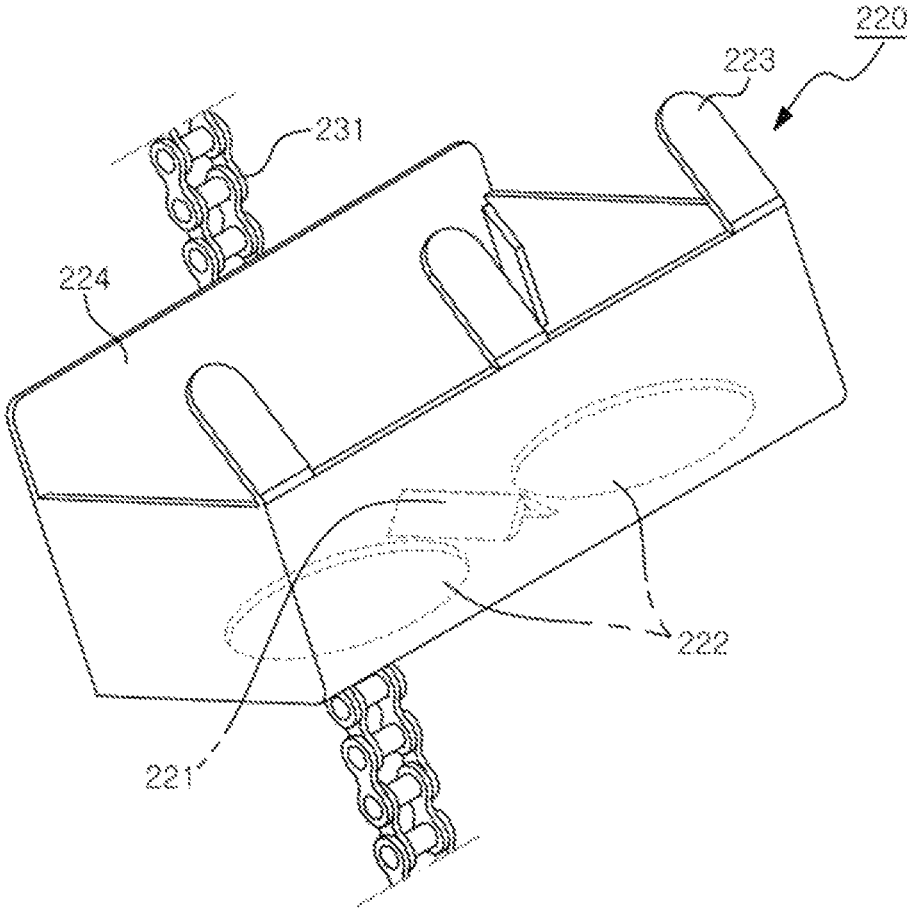
FIG. 18 is a perspective view showing yet another example of the tray.
Figure 19:
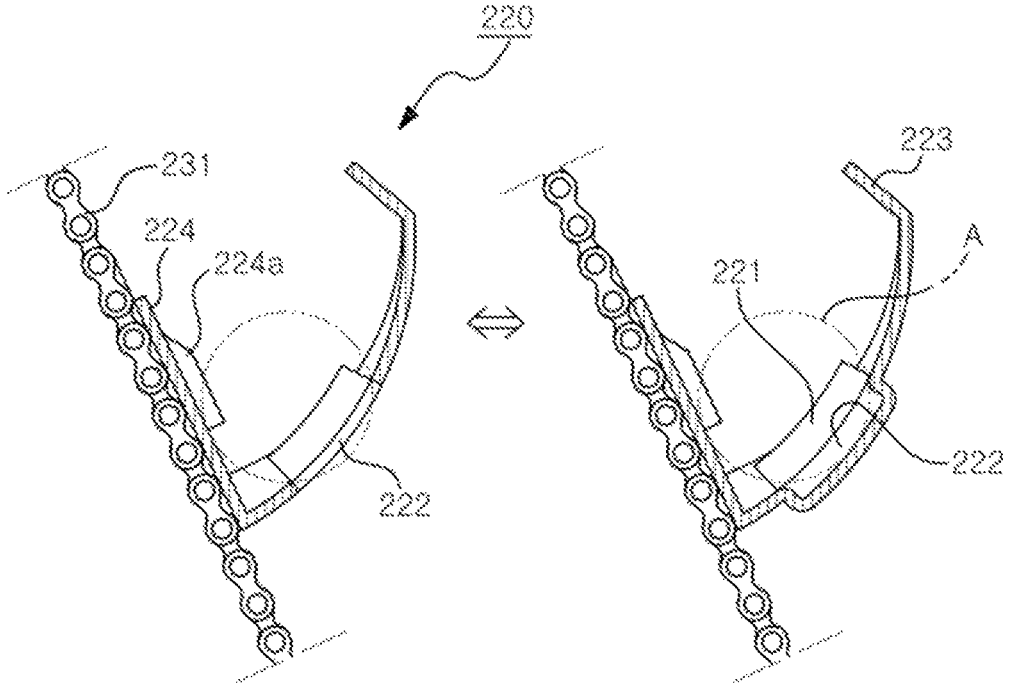
FIG. 19 is a side sectional view showing yet another example of the tray.

FIG. 18 is a perspective view showing yet another example of the tray, and FIG. 19 is a side sectional view showing yet another example of the tray.

As shown in FIG. 18, each tray 220 as yet another example has the shape of a bucket and includes one or more seating spaces 222 concaved downward or punched thereon to seat the table tennis ball A thereonto and forks 223 formed on the front side thereof to induce the table tennis ball A to the seating spaces 222 and having ends bent inward toward the second chain 231.

The automatic table tennis training apparatus 10 having the above-mentioned configuration allows the table tennis balls A dropped to the first and second guide plates 135 and 138 to be supplied to the pitching machine 110 and further includes the table tennis ball transfer device 200, so that as the table tennis balls A are transferred through the trays 220 coupled to the second chain 231, no noise is generated to the outside, and as the player is concentrated on the training, accordingly, his or her table tennis skills can be improved. Even though he or she trains table tennis for long hours, further, he or she can be excited all the time, without feeling bored.

According to the present invention, each tray 220 has guide protrusions 221 so that after the table tennis ball A enters the tray 220, it is induced by the guide protrusions 221 and then seated onto the seating spaces 222, thereby enabling the table tennis ball B to be fixedly seated onto the interior of the tray 220.

According to the present invention, when each tray 220 is coupled to the second chain 231, the tray 220 is installed tilted to the given angle D from the center of the second chain 231 so that another table tennis balls A except the table tennis ball A seated onto one seating space 222 of the tray 220 can be efficiently seated onto the other seating space 222.

According to the present invention, each tray 220 includes escape prevention inducing plates 224*a* located on both sides of the discharge plate 224 to allow the table tennis ball A transferred thereto to be gently discharged to the supply path 300, without escaping therefrom or being dropped to the outside floor, when the table tennis ball A is discharged to the supply path 300.

The supply path 300 forms an inclined path from one side of top of the table tennis ball transfer device 200 to the collecting stand 120, while having both side walls, to supply the table tennis balls A to the collecting stand 120.

The supply path 300 has spaces 310 formed on the end toward the table tennis ball transfer device 200 to allow the forks 222 of the trays 220 coupled to the second chain 231 rotatingly connected to the fourth sprocket 314 located on the upper portion of the housing 210 of the table tennis ball transfer device 200 to pass therethrough.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

Further, parts that have no relation with the description are omitted in the drawings to obviously explain the present invention, and the widths, lengths, and thicknesses of the components shown in the drawings may be magnified or downsized for the clarity and convenience of the description.

In the description, it should be noted that the parts corresponding to those of the drawings are indicated by corresponding reference numerals.

The invention claimed is:

1. An automatic table tennis training apparatus comprising:

a rectangular table tennis table (100) divided into a first court (102) on one side thereof and a second court (103) on the other side thereof, with respect to a net (101) disposed vertically thereon in a width direction thereof, and having a height determined by support posts supporting the underside thereof;

a pitching machine (110) located on an end portion of the first court (102) and having a plurality of rotary wheels spaced apart from one another in such a manner as to be controlled in rotation speeds to launch the table tennis balls supplied sequentially thereto toward the second court (103), while changing the rotary speeds and directions of the table tennis balls launched;

a collecting stand (120) located on the end portion of the first court (102) and having an entry hole (113) formed on a lower portion thereof to allow the table tennis balls to enter the inside thereof and a transfer device disposed therein to transfer the table tennis balls upward through a transfer path along which the table tennis balls are transferred upward to thus collect and supply the table tennis balls that have been transferred or dropped to the pitching machine (110);

a fence part (130) having a lower guide (131) located horizontally with respect to the ground and a net cage (132) provided upward from the lower guide (131) to thus form a space in which the table tennis table (100) divided into the first court (102) on one side thereof and the second court (103) on the other side thereof, with respect to the net (101) disposed vertically thereon in the width direction thereof, and having the height determined by the support posts supporting the underside thereof is placed, to limit the escape range of the table tennis balls, and to guide the movement directions of the table tennis balls dropped to the ground;

a blowing part (140) for blowing the table tennis balls dropped to the ground to move the table tennis balls towards one side end of the lower guide (131) located under the table tennis table (100); and a transfer part (150) for sucking the table tennis balls moving to one side end of the lower guide (131) to transfer the table tennis balls to the collecting stand (120), wherein the transfer part (150) comprises:

one or more sensors for sensing the table tennis balls moving to one side end of the lower guide (131);

a transfer hose (151) having an inlet formed on one side end thereof toward one side end of the lower guide (131) and an outlet formed on the other side end thereof in such a manner as to pass through a through hole (122) formed on one side of the collecting stand (120) or fitted to the through hole (122); and a suction device for forming a pressure difference between the inside and outside of the transfer hose (151) if the table tennis balls are sensed by means of the sensors.

2. The automatic table tennis training apparatus according to claim 1, further comprising:

sensing parts (160) for sensing initial collision points of the table tennis balls hit by a player after the table tennis balls are launched from the pitching machine (110) against top of the first court (102);

a calculating part for calculating the hitting scores of the player, based on the initial collision points sensed; and a display device for in real time displaying the player's hitting scores calculated by the calculating part on a screen.

3. An automatic table tennis training apparatus comprising:

a rectangular table tennis table (100) divided into a first court (102) on one side thereof and a second court (103) on the other side thereof, with respect to a net (101) disposed vertically thereon in a width direction thereof, and having a height determined by support posts supporting the underside thereof;

a pitching machine (110) located on an end portion of the first court (102) to launch, towards the second court (103), table tennis balls A supplied sequentially thereto;

a collecting stand (120) located on the end portion of the first court (102) to collect the table tennis balls (A) that have been transferred or dropped and thus supply the table tennis balls (A) to the pitching machine (110);

a fence part (130) having a lower guide (131) located horizontally with respect to the ground and a net cage (132) provided upward from the lower guide (131) to thus form a space in which the table tennis table (100) is placed, to limit the escape range of the table tennis balls (A), and to guide the movement directions of the table tennis balls (A) dropped to the ground;

a table tennis ball transfer device (200) located under the first court (102) to transfer the table tennis balls (A) dropped to the ground to the pitching machine (110) and comprising a housing (210) having a driving motor (240) located at the rear side thereof and upper and lower sprockets disposed on the front, upper and lower sides thereof to install first and second chains (230 and 231) thereon and trays (220) mounted on the second chain (231) at given intervals and each having seating spaces (222) formed at the inside thereof, forks (223) formed on the front side thereof to lift up the table tennis ball (A) collected to a guide recess (136) formed at the center of the lower guide (131), and a discharge plate (224) located on the rear side thereof, and a supply path (300) for forming an inclined path from one side of top of the table tennis ball transfer device (200) to the collecting stand (120), while having both side walls, to supply the table tennis balls (A) transferred from the table tennis ball transfer device (200) to the collecting stand (120).

4. The automatic table tennis training apparatus according to claim 3, wherein when each tray (220) is coupled to the second chain (231), the tray (220) is installed tilted by a given angle (D) to one side from the center of the second chain (231).

5. The automatic table tennis training apparatus according to claim 3, wherein the ends of the forks (223) are bent inward toward the second chain (231).

6. The automatic table tennis training apparatus according to claim 3, wherein each tray (220) has the shape of a plate, while having one or more seating spaces (222) concaved downward or punched on the inside thereof.

7. The automatic table tennis training apparatus according to claim 6, wherein each tray (220) has guide protrusions (221) protruding from both sides thereof and the inner center thereof.

8. The automatic table tennis training apparatus according to claim 3, wherein each tray (220) has the shape of a bucket, while having one or more seating spaces (222) concaved downward or punched on the inside thereof.

9. The automatic table tennis training apparatus according to claim 3, wherein each tray (220) has guide protrusions (221) protruding from both sides thereof and the inner center thereof.

10. The automatic table tennis training apparatus according to claim 3, wherein each tray (220) has escape prevention inducing plates (224*a*) located on both sides of the discharge plate (224).

11. The automatic table tennis training apparatus according to claim 3, wherein the guide recess (136) is formed to allow the forks (223) of the trays (220) to pass therethrough, while inserting the forks (223) thereinto.

* * * * *